US005663934A

United States Patent [19]

Wenger et al.

[11] Patent Number: 5,663,934

[45] Date of Patent: Sep. 2, 1997

[54] WATERTIGHT PUSH BUTTON DEVICE, PARTICULARLY FOR CONTROLLING A TIMEPIECE

[75] Inventors: Sylvain Wenger, Commugny; Joseph Eray, Glovelier, both of Switzerland

[73] Assignee: Werthanor S.A., Le Locle, Switzerland

[21] Appl. No.: 521,816

[22] Filed: Aug. 31, 1995

[30] Foreign Application Priority Data

Sep. 1, 1994 [CH] Switzerland ..... 02 674/94

[51] Int. Cl.[6] ..... G04B 29/00; G04B 37/00

[52] U.S. Cl. ..... 368/290; 368/319

[58] Field of Search ..... 368/287–291, 368/306, 308, 319–321

[56] References Cited

U.S. PATENT DOCUMENTS

| | | | |
|---|---|---|---|
| 3,362,153 | 1/1968 | Wenger | 368/290 |
| 3,453,819 | 7/1969 | Simon | 58/90 |
| 3,944,030 | 3/1976 | Yokoyama | 188/298 |
| 3,949,303 | 4/1976 | Nishimura | 325/396 |
| 3,961,147 | 6/1976 | Alonas | 200/159 |
| 3,977,178 | 8/1976 | Wenger | 368/290 |
| 5,257,247 | 10/1993 | Miche et al. | 368/290 |
| 5,299,179 | 3/1994 | Miche et al. | 368/290 |

FOREIGN PATENT DOCUMENTS

| | | |
|---|---|---|
| 1345601 | 11/1963 | France . |
| 2417683 | 9/1979 | France . |
| 672041 | 10/1989 | Switzerland . |

*Primary Examiner*—Vit W. Miska

*Attorney, Agent, or Firm*—Griffin, Butler, Whisenhunt & Kurtossy

[57] ABSTRACT

The watertight push button device is intended for example to equip a timepiece, in particular for controlling said timepiece. It comprises a body (2) inside which a cavity (4) of generally oblong shape is arranged, and a push button stem (6) arranged inside the cavity (4) and capable of moving, inside the latter, by a sliding movement when its head (8) is pushed.

In order to prevent a shock at the end of the travel and/or an accidental activation of the push button, the device comprises pneumatic means intended to dampen the sliding movement of the stem (6) inside the body (2). These pneumatic means comprise an annular chamber defined around the stem (6) by a fixed gasket (28) and one of the sealing gaskets (20,22) mounted on the stem. Leakage means are preferably provided between the fixed gasket and the stem or the body.

7 Claims, 1 Drawing Sheet

WATERTIGHT PUSH BUTTON DEVICE, PARTICULARLY FOR CONTROLLING A TIMEPIECE

BACKGROUND OF THE INVENTION

The present invention concerns a watertight push button device, particularly for controlling a timepiece, said device comprising:

a body inside which an oblong cavity is arranged, a stem slidingly arranged in said cavity and connected to a push button head in order to move axially against the force of a return spring when a control push is applied to the push button head, and sealing means ensuring a watertight sealing of said cavity on the side of the push button head.

In the watchmaking field, conventional push button devices comprise a body which is generally termed a "push button tube", and inside which is arranged an open cavity having oblong shape. A stem is arranged in this cavity, called a push button stem, which extends longitudinally inside said body.

In most applications, this device also comprises a return spring which abuts firstly the base of said aforementioned body, and secondly a shoulder arranged on the stem.

Further, a push button head is driven onto a first end of the push button stem which projects out of the body, this stem comprising, at its second end, a screw which is intended to come into contact with a control member of the timepiece. This screw, under the action of the return spring, is brought to abut the base of the body, which prevents the movement of the push button stem beyond a certain limit during its return movement.

This type of device may be actuated very easily by the wearer of the timepiece to activate the corresponding control of this timepiece. However, it is known that these controls which are generally made up of mechanical components are very fragile since they are often made of metallic parts of small thickness, these metallic parts, which may be very complex, cooperating in turn with other mechanical components of the timepiece to assure the control of the required function.

It can thus be seen that brutal or too rapid actions applied to the push button device may seriously damage said control components, the timepiece being in such case inoperable and requiring repair by an expert watchmaker.

On the other hand, in conventional push buttons of timepieces such as chronographs, the return spring is pre-compressed relatively tightly in order to prevent the push button being accidentally actuated, for example if an obstacle or a part of the body of the wearer comes into contact with the push button head. Thus, as soon as the head is pushed with sufficient force to overcome that of the spring, the sliding movement of the stem is then achieved with a relatively small increase in the force to be applied. Consequently, an accidental push often leads to a full depression of the stem and unintentional activation of the corresponding function of the timepiece. If one wishes to avoid this disadvantage by increasing the initial force of the spring, normal manual actuation may become difficult. Furthermore the spring becomes too cumbersome.

Swiss patent No. 672 041 discloses a watertight push button device of the type specified above, in which the water resistance is assured by resilient metallic bellows fixed to the head and body of the push button. Due to its corrugated profile, the bellows act as a spring component complementing the conventional spring. However, this construction does not assist in avoiding the problems cited above.

SUMMARY OF THE INVENTION

An aim of the present invention is thus to provide a push button device which mechanically protects the movement of the timepiece which is equipped with it, and which protects, in particular, its control components from any action which risks seriously damaging this movement and its components, while guaranteeing convenient and comfortable operation for the user. Another aim consists in preventing an unintentional activation of the functions controlled by the push button device.

The present invention concerns thus a push button device of the type defined above, characterised in that said cavity contains pneumatic means which cooperate with said cavity and said stem for defining an annular chamber the volume of which varies with the sliding movement of the stem under the effect of said control push so that the pressure of the air in the chamber opposes a resistance to said movement.

Thus, as soon as the stem begins to move, a pneumatic resistant force appears and increases from zero to a maximum value with the amplitude of the movement of the stem. One thus obtains a better resistance at the end of the travel, which reduces the shock when the stem comes into contact with the component which it controls. The initial resistance force, being produced solely by the spring, may be equal or even decreased in comparison to a conventional push button.

In an advantageous embodiment of the invention, the pneumatic means comprise leakage means allowing a limited of the air contained in the annular chamber. This enables the dampening effect of the stem movement to be improved, in particular for preventing a hard contact with the component to be controlled.

Other features and advantages of the invention will appear more clearly upon reading the detailed description which follows, with reference to the attached drawing.

BRIEF DESCRIPTION THE DRAWING

FIG. 1 shows a longitudinal cross-section of a preferred embodiment of the push button device according to the invention.

DETAILED DESCRIPTION

Figure 1:
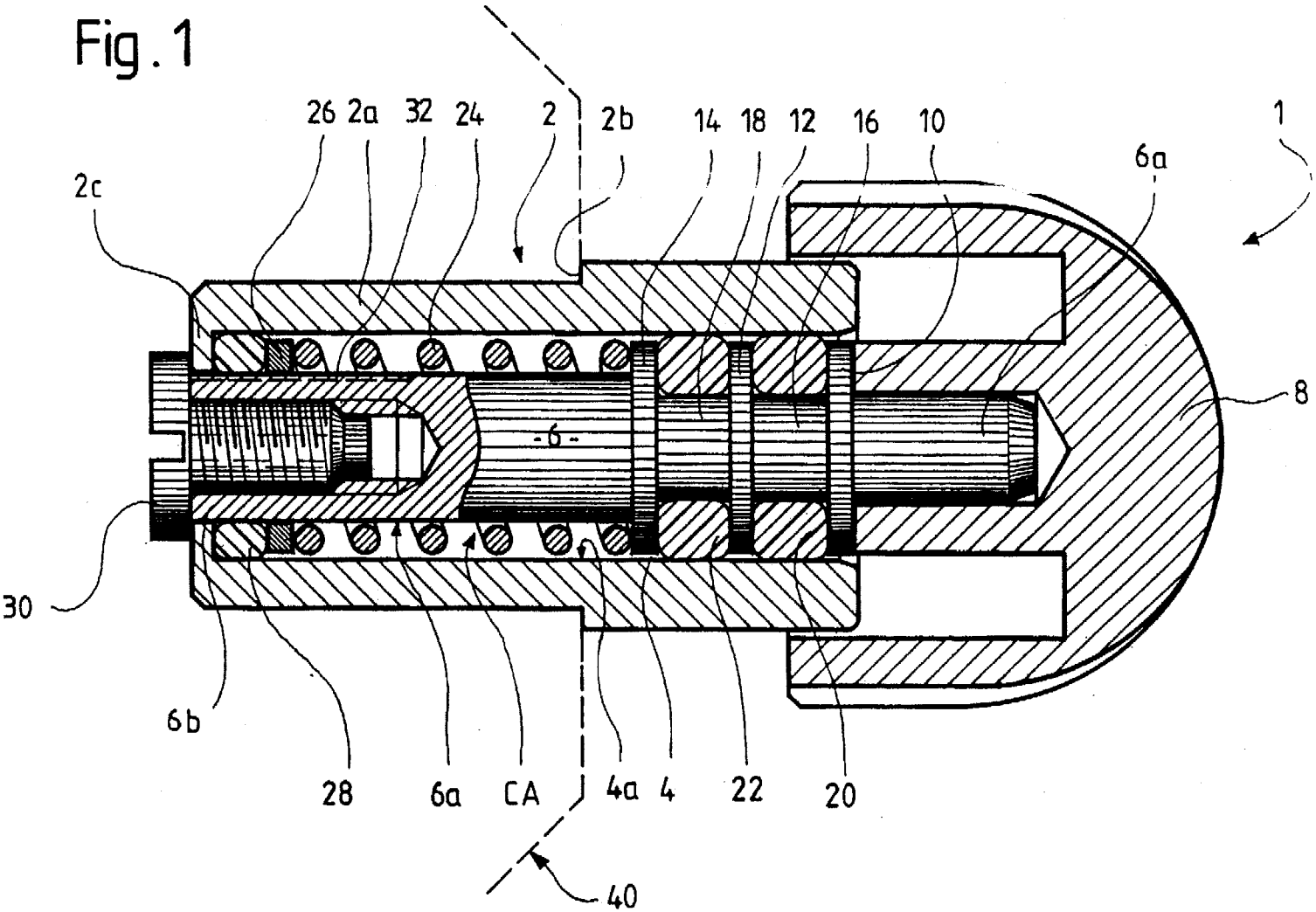

As is seen in the attached drawing, the push button device according to the invention which is designated by the general reference 1, comprises a body 2 generally called the push button tube which, in the embodiment shown, is formed by a cylindrical tube. A forward portion **2*a* of this tube, limited by a shoulder 2*b*, is intended to be driven into an orifice of a support in which the device is mounted, for example a case of a timepiece 40**.

Inside the body or push button tube 2 is arranged a cavity 4 of a general oblong cylindrical shape, which is open at the two ends of body 2.

This push button device 1 also comprises a push button stem 6 which is positioned inside cavity 4 and which is arranged so as to be able to move in this cavity by a sliding movement along a longitudinal axis (not referenced) of body 2.

Push button stem 6 comprises outside the timepiece case 40 a protruding end **6*a* into which a push button head 8, having an outer shape such that it enables push button device 1** to be actuated by a user, is driven and held firm.

Close to this first protruding end **6*a* several flanges, in this case three flanges respectively referenced 10, 12 and 14, are arranged on stem 6**.

Flanges 10, 12 and 14 form shoulders on stem 6, which define a pair of annular grooves 16 and 18 in which two elastomeric material sealing gaskets 20 and 22 are respectively housed. Although the embodiment shown comprises two mobile gaskets, it is clear that, without departing from the framework of the invention, a single gasket may be provided in this part of the device to fulfil the desired function.

It is also to be noted that push button head 8 axially abuts flange 10, while the last flange 14 acts as axial counter-support to a helical compression spring 24 which, firstly, axially draws stem 6 to an initial rest position shown in the drawing, and secondly, axially draws an intermediate washer 26 abutting a third sealing gasket 28. Sealing gasket 28 which is likewise made of elastomeric material, axially abuts a base 2*c* of body or push button tube 2. Finally, it is to be noted that the device preferably comprises a screw 30 which is screwed into a second end 6*b* of stem 6 and which forms a stop preventing stem 6 from leaving cavity 4, under the action of return spring 24.

It is also to be noted that the two sealing gaskets 20 and 22 which are mobile gaskets driven by the sliding movement of stem 6, radially contact the internal wall 4*a* of cavity 4 and slide against the latter, while sealing gasket 28 which is fixed in translation inside push button device 1, by being blocked by washer 26, radially contacts the external wall 6*a* of stem 6 which slides against this gasket 28. It will also be noted that fixed gasket 28, which rests against base 2*c* of cavity 4, is held against this base 2*c* by helical compression spring 24 which forms a resilient return element of stem 6, contributing to the holding of gasket 28 and to its dynamic sealing action on stem 6, stem 6 sliding in this gasket when push button device 1 is actuated by a user.

One will also note that the region of cavity 4 which is situated between fixed sealing gasket 28 and mobile sealing gaskets 20 and 22 defines an annular chamber CA which is of variable volume and contains a gas, e.g. air.

Thus, when stem 6 is axially actuated by the user who pushes on push button head 8, the axial movement of this stem 6 and thus the concomitant movement of sealing gaskets 20 and 22 compresses the air within annular chamber CA. The very function of stem 6, which acts as piston inside body 2, has thus been transformed.

However, the evacuation of the air which is contained in this chamber CA and which preferably may be expelled from the latter by the action of mobile gaskets 20 and 22 is slowed down by the presence of fixed gasket 28 which is preferably sized and selected so as to guarantee sufficient leakage to enable the sufficiently rapid but dampened movement of stem 6.

According to an alternative, a small flat part 32, represented by a dotted line, is machined along one side of stem 6, in the contact area between the stem and fixed gasket 28, to enable a limited leakage of air between annular chamber CA and the exterior of body 2 in both directions of movement of the stem.

Pneumatic means providing resistance to the movements of stem 6 inside body 2 are thus provided, these means, which are integrated into this body, guaranteeing the dampening of the sliding movement of this stem, when the operating control is applied to push button device 1.

Therefore, since the sliding movement of stem 6 inside body 2 is dampened, the speed of movement of the stem is substantially reduced at the end of the travel and prevents any hard action which could be applied by this stem to an operating component, not shown, belonging to a timepiece.

It is thus clear that these pneumatic dampening means also avoid any unintentional control command on push button head 8 and therefore prevent undesired activation of the functions of the timepiece, because a small accidental shock on push button head 8 is dampened by the gradual pneumatic resistance and generally does not produce a full movement to the base. If the initial force of the spring is the same as in a conventional push button, the total resistance force at the end of the travel is increased by the pneumatic system. Alternatively a smaller, weaker spring could be used, still obtaining a sufficient resistance at the end of the travel.

A device according to the invention can be used not only for controlling a timepiece, but also for controlling other components such as electric contacts.

What is claimed is:

1. A watertight push button device, particularly for controlling a timepiece, said device comprising:

a body inside which an oblong cavity is arranged, a stem slidingly arranged in said cavity and connected to a push button head so as to move axially against the force of a return spring when a control push is applied to said push button head, and sealing means ensuring a watertight sealing of said cavity on the side of said push button head, wherein said cavity contains pneumatic means which cooperate with said cavity and said stem for defining an annular chamber the volume of which varies with the sliding movement of said stem under the effect of said control push so that the pressure of air contained in said annular chamber opposes a resistance to said movement, said pneumatic means comprising at least two annular gaskets, namely a mobile gasket which is fixedly engaged with the stem and which slides in radial contact against an internal wall of the cavity, and a gasket which is fixed in said cavity and in which said stem slides.

2. A device according to claim 1, wherein said mobile gasket forms part of said sealing means.

3. A device according to claim 1, wherein said fixed gasket rests against the base of the cavity, and is held against this base by said return spring.

4. A device according to claim 3, wherein said return spring is a compression spring housed in said annular chamber.

5. A device according to claim 4, wherein said return spring abuts on one side an intermediate washer which abuts said fixed gasket, and on the other side a counter-support component arranged on said stem between said return spring and said mobile gasket.

6. A device according to claim 1, wherein said pneumatic means comprise leakage means enabling a limited leakage of the air contained in said annular chamber.

7. A device as claimed in claim 6, wherein said pneumatic means comprises: a mobile annular gasket fixedly engaged with the stem and which slides in radial contact against an internal wall of the cavity, and a fixed annular gasket which is fixed in said cavity and in which said stem slides, and, leakage means arranged in a contact area between said fixed annular gasket and one of the group of elements consisting of said stem and said body and enabling a limited leakage of the air contained in said annular chamber.

* * * * *